US008240010B2

(12) United States Patent
O'Donnell

(10) Patent No.: US 8,240,010 B2
(45) Date of Patent: Aug. 14, 2012

(54) MONEY CLIP HAVING INTERCHANGABLE COVERS WITH LOGO SURFACES

(76) Inventor: Charles J. O'Donnell, Atlantic Highlands, NJ (US)

( * ) Notice: Subject to any disclaimer, the term of this patent is extended or adjusted under 35 U.S.C. 154(b) by 260 days.

(21) Appl. No.: 12/584,235

(22) Filed: Sep. 2, 2009

(65) Prior Publication Data

US 2011/0047761 A1 Mar. 3, 2011

(51) Int. Cl.
*B42F 1/04* (2006.01)

(52) U.S. Cl. ..... 24/67.5; 24/558

(58) Field of Classification Search ..... 24/67.3, 24/67.5, 557, 558, 565; 40/666, 652, 658, 40/661.01, 359, 360, 641
See application file for complete search history.

(56) References Cited

U.S. PATENT DOCUMENTS 4,761,862 A * 8/1988 Hiromori ..... 24/67.9
4,802,263 A * 2/1989 Lorber ..... 24/67.5
6,240,604 B1 * 6/2001 Fox ..... 24/429
6,327,749 B1 * 12/2001 Antinone ..... 24/67 R
6,745,805 B2 * 6/2004 Thomson ..... 150/137
7,770,263 B2 * 8/2010 Thomson et al. ..... 24/67.7

FOREIGN PATENT DOCUMENTS

JP 08132775 A * 5/1996
JP 2005186515 A * 7/2005

* cited by examiner

*Primary Examiner* — James Brittain

(57) ABSTRACT

An improved money clip for holding and securing a stack of money, credit cards, and business documents. The money clip includes a gripping member 12 having a U shape which includes gripping sections 14, 16, and 18, and a first set of pivot sections formed on the lower edge of gripping section 14, and a second set of pivot sections formed on the lower edge of gripping section 18. The first and second gripping legs 20 and 22 each having pivots members at their upper ends which are pivotally and removably connected to the first and second set of pivot sections formed on the gripping sections 14 and 18. A third gripping leg 24 is provided having pivot members at its upper ends which is interchangeable with the first or second gripping legs 20 or 22. In addition, logo support members are formed on the first, second, or third gripping legs for receiving logos or pictures thereon which have magnetic surfaces for receiving logos thereon. The gripping sections 14, 16, or 18 may be coated with a metallic surface to provide a coated surface for receiving engravings thereon.

1 Claim, 9 Drawing Sheets

MONEY CLIP HAVING INTERCHANGABLE COVERS WITH LOGO SURFACES

FIELD OF THE INVENTION

The present invention relates to an improved money clip for gripping and holding money, credit cards, and business documents.

BACKGROUND OF THE INVENTION

Although money clips have been used in the past, they have certain disadvantages. For example, they are not thick enough to hold a stack of money, credit cards, and business documents. In addition, U.S. Pat. No. 6,327,749 is an example of a prior money clip that does not teach using the gripping legs in a manner so that they are interchangeable.

Accordingly, it is an object of the present invention to provide an improved money clip that has interchangeable gripping legs, and includes surfaces or sections for receiving logos or pictures.

SUMMARY OF THE INVENTION

The present invention provides an improved money clip for holding and securing a stack of money, credit cards, and business documents. The money clip includes a gripping member 12 having a U shape which includes gripping sections 14, 16, and 18, and a first set of pivot sections formed on the lower edge of gripping section 14, and a second set of pivot sections formed on the lower edge of gripping section 18. The first and second gripping legs 20 and 22 each having pivots members at their upper ends which are pivotally and removably connected to the first and second set of pivot sections formed on the gripping sections 14 and 18. A third gripping leg 24 is provided having pivot members at its upper ends which is interchangeable with the first or second gripping legs 20 or 22. In addition, support members are formed on the first, second, or third gripping legs for receiving logos or pictures thereon which have magnetic surfaces for receiving logos thereon. The gripping sections 14, 16, or 18 may be coated with a metallic coating to provide a coated surface for receiving engravings thereon.

DETAILED DESCRIPTION OF THE PREFERRED EMBODIMENT

Figure 1:
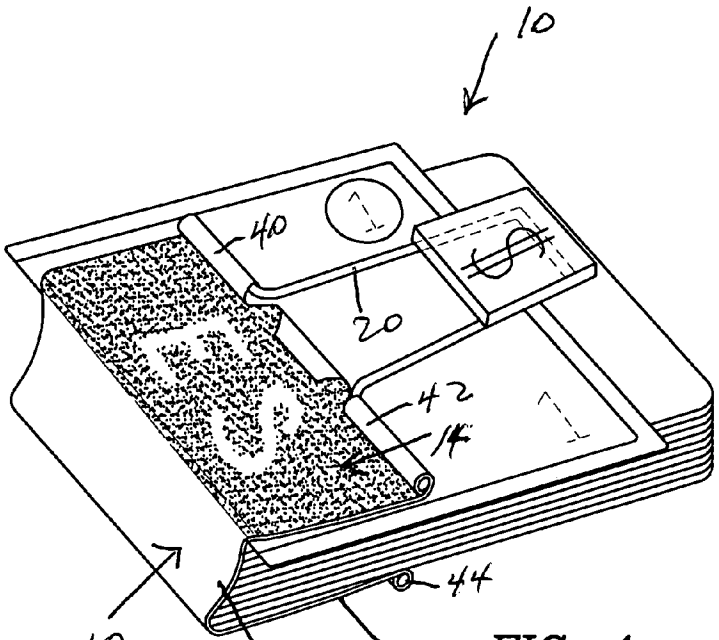
FIG. 1 is perspective view of the money clip of the present invention.

The present invention provides an improved money clip 10 for holding and securing a stack of money, credit cards, and business documents 30. The money clip 10 includes a gripping member 12 having a U shape which includes gripping sections 14, 16, and 18, and a first set of pivot sections 40 and 42 formed on the lower edge of gripping section 14, and a second set of pivot sections 44 and 46 formed on the lower edge of gripping section 18. The first and second gripping legs 20 and 22 each have pivots members 50 and 52 at their upper ends which are pivotally and removably connected to the first and second set of pivot sections 40, 42, 44, and 46 formed on the gripping sections 14 and 18.

A third gripping leg 24 is provided having pivot members 60 and 62 at its upper ends which is interchangeable with the first or second gripping legs 20 or 22 for interchanging logos or pictures on the money clip 10. In addition, support members 70 are formed on the first, second, or third gripping legs 20, 22, and 24 for receiving logos 80 or pictures 82 thereon which have magnetic surfaces 90 for receiving logos 80 or pictures 82 thereon. The gripping sections 14, 16, or 18 may be coated with a metallic coating to provide a coated surface 100 for receiving engravings thereon, as shown in FIG. 1, on surface 14.

The height of gripping section 16 may be in the range of ½" to 1½" to hold more cards or money. The height of gripping sections 14 and 18 may be in the range of ½" to 1½". The width of gripping sections may be in the range of ¾" to 2¾".

Figure 1A:
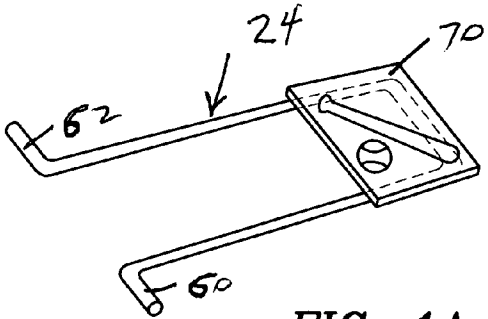
FIG. 1A is a perspective view of a third interchangeable gripping leg.

FIG. 1 shows money clip 10 having an engraved surface 14, and FIG. 1A shows an interchangeable leg 24 which can be interchanged with legs 20 or 22.

Figure 2:
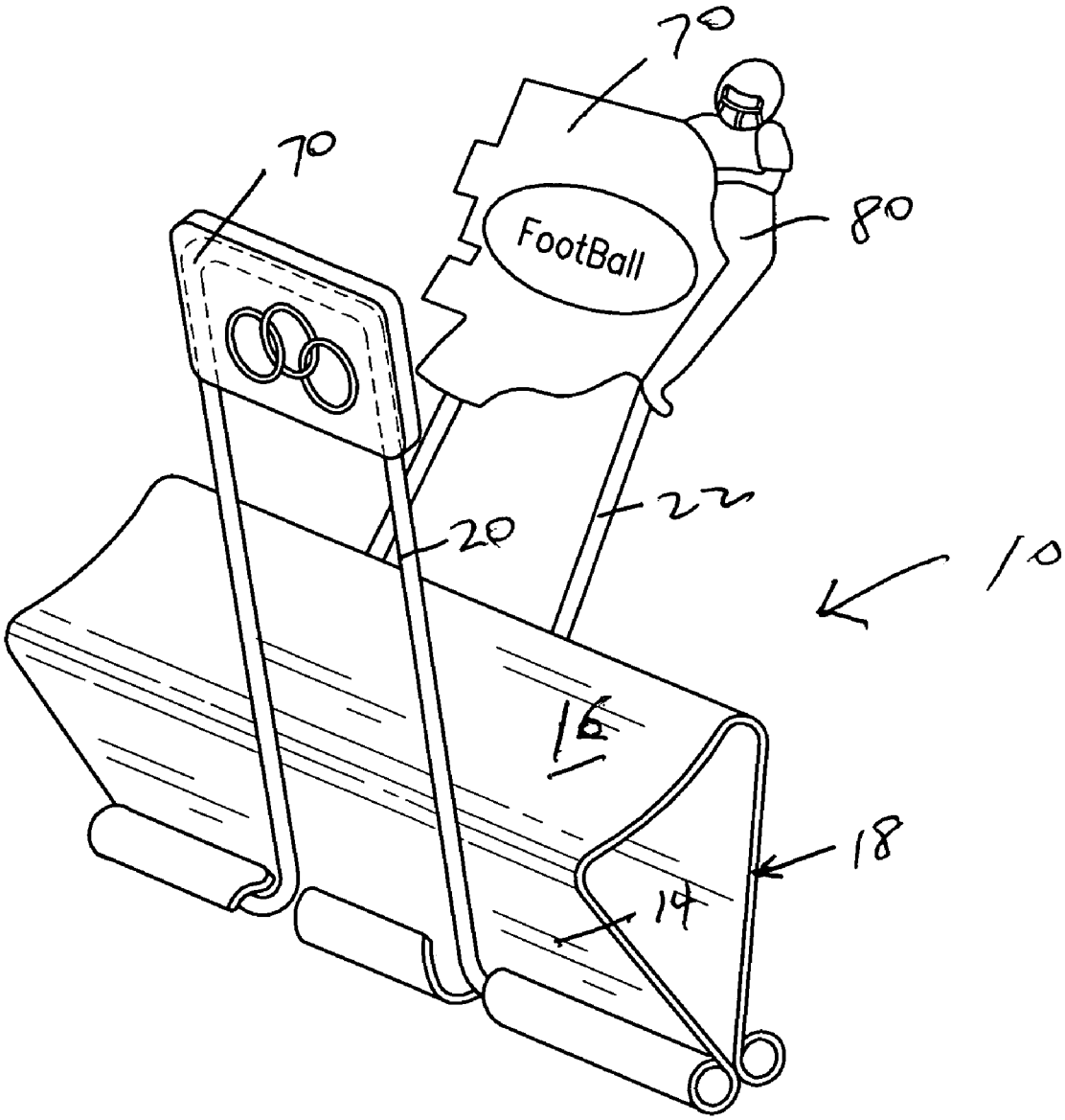
FIG. 2 is perspective view of the money clip of the present invention having a logo support member thereon.
Figure 3:
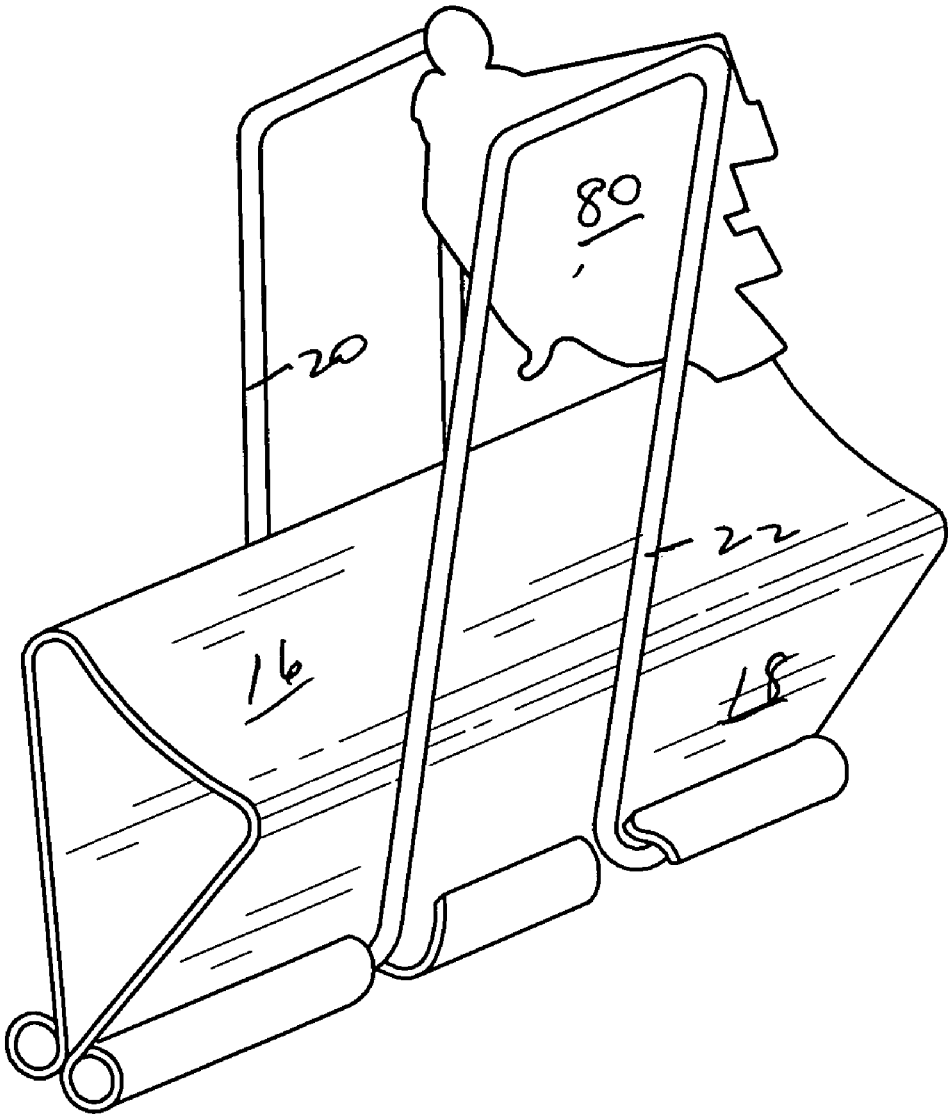
FIG. 3 is perspective view of the money clip of the present invention showing the opposite side of the logo support member thereon.

FIG. 2 shows different logos 70—on legs 20 and 22, and FIG. 3 shows logo 80 glued or welded to leg 22.

Figure 4:
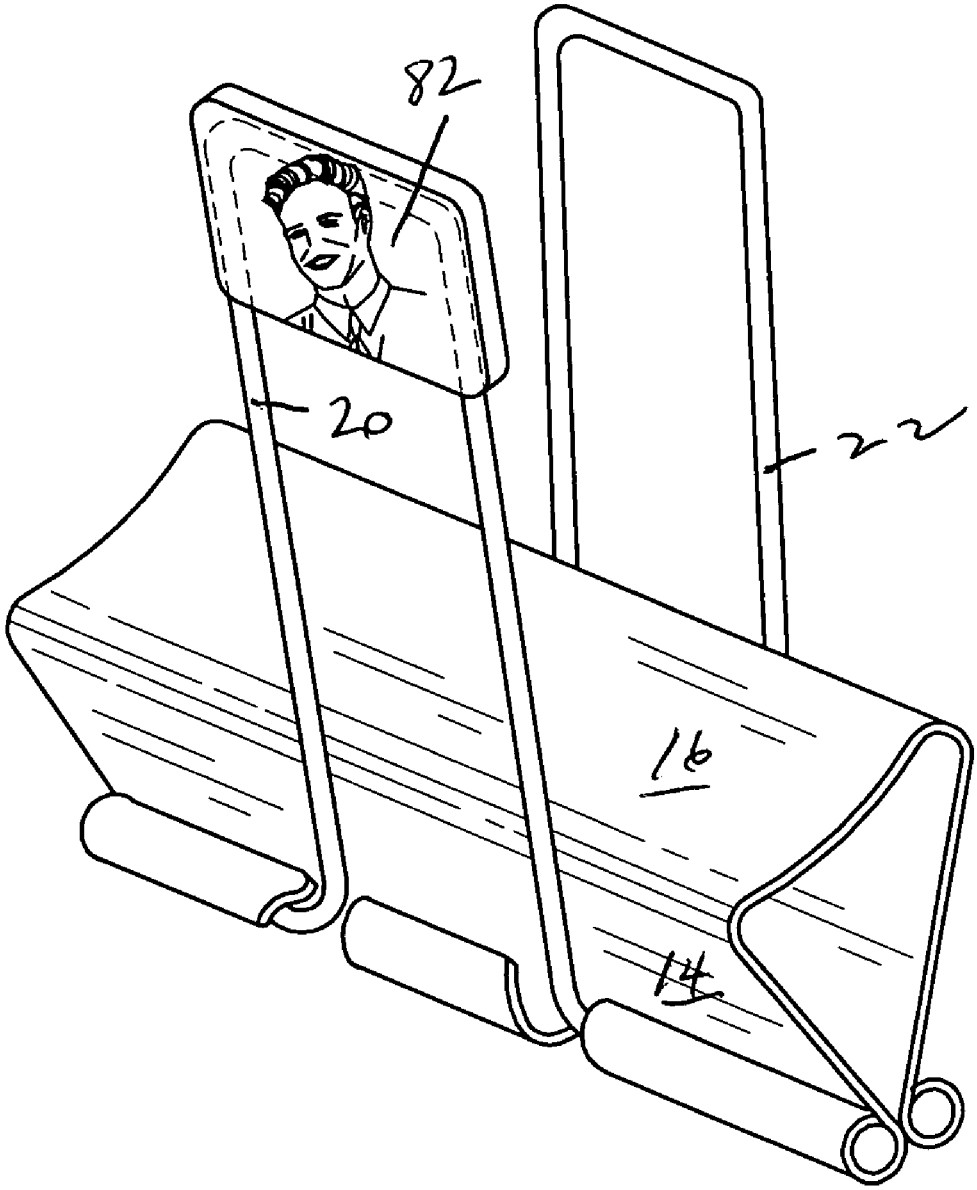
FIG. 4 is perspective view of the money clip of the present invention having a picture support member thereon.

FIG. 4 shows support member 70 with picture 82 attached to leg 20.

Figure 5:
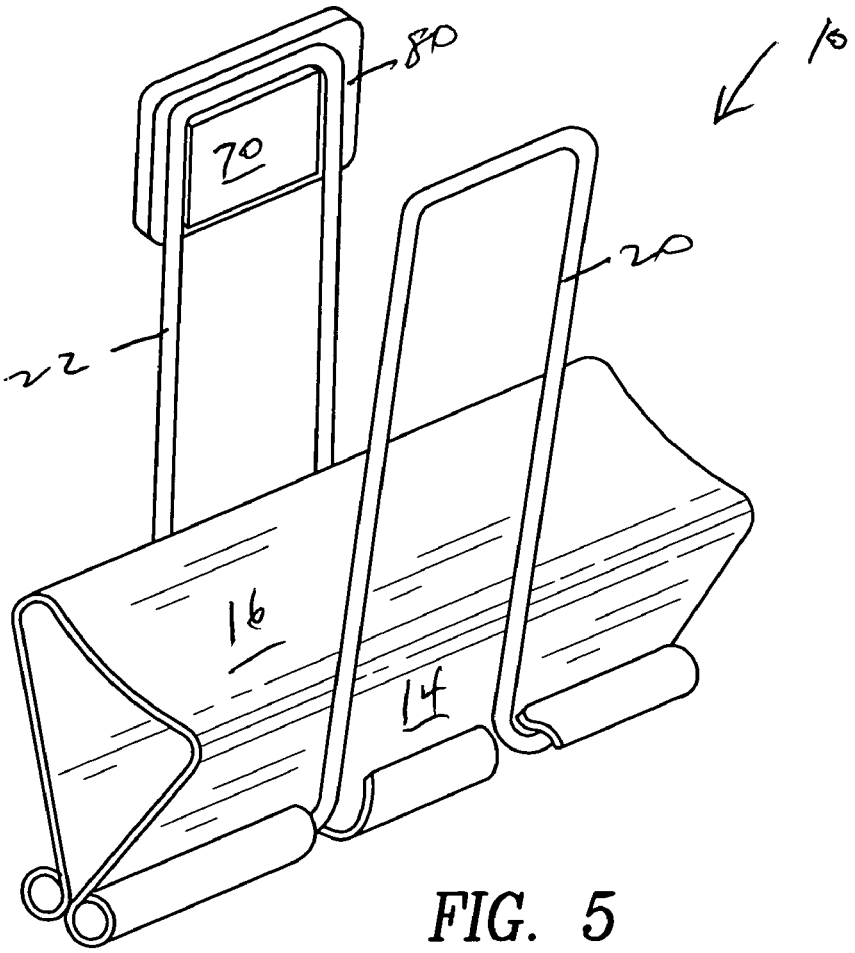
FIG. 5 is perspective view of the money clip of the present invention showing the opposite side of the picture support member thereon.
Figure 6:
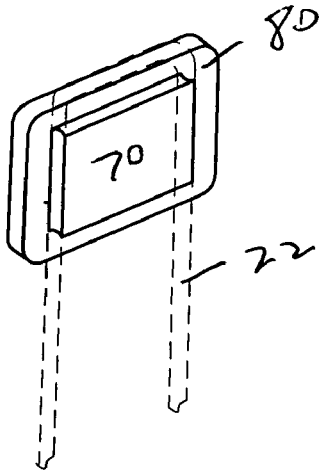
FIG. 6 is an assembly view showing how the support member is placed on the gripping section.

FIG. 5 shows logo 80 mounted on support 70 which fits inside of legs 22, and FIG. 6 shows a detail of this.

Figure 7:
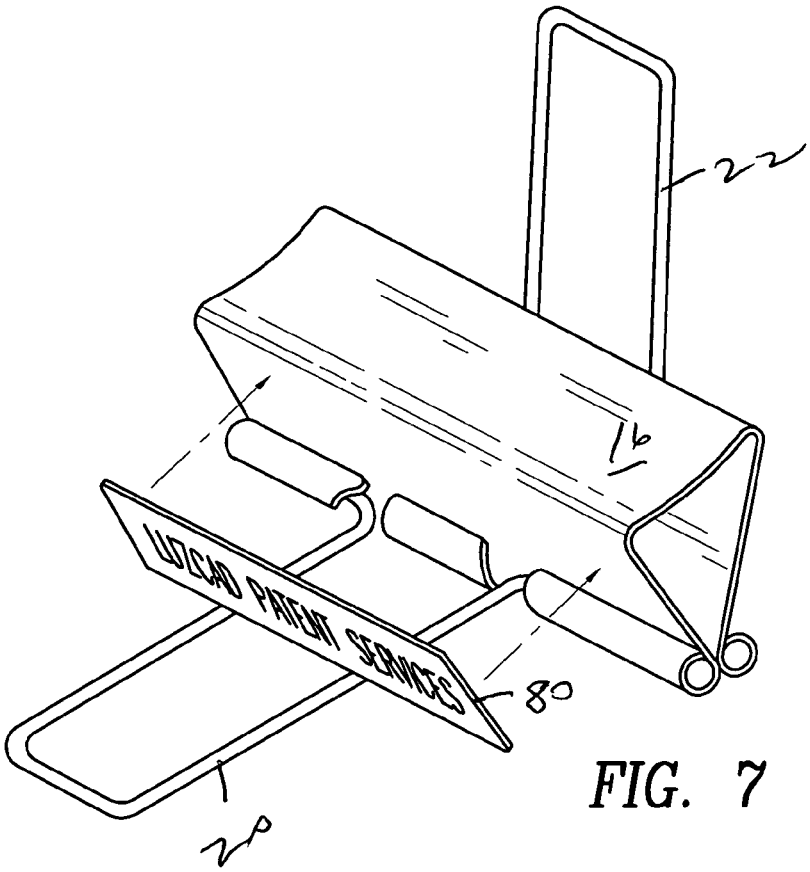
FIGS. 7 and 8 are perspective views each showing placement of a magnetic member on one of the gripping legs of the money clip.
Figure 8:
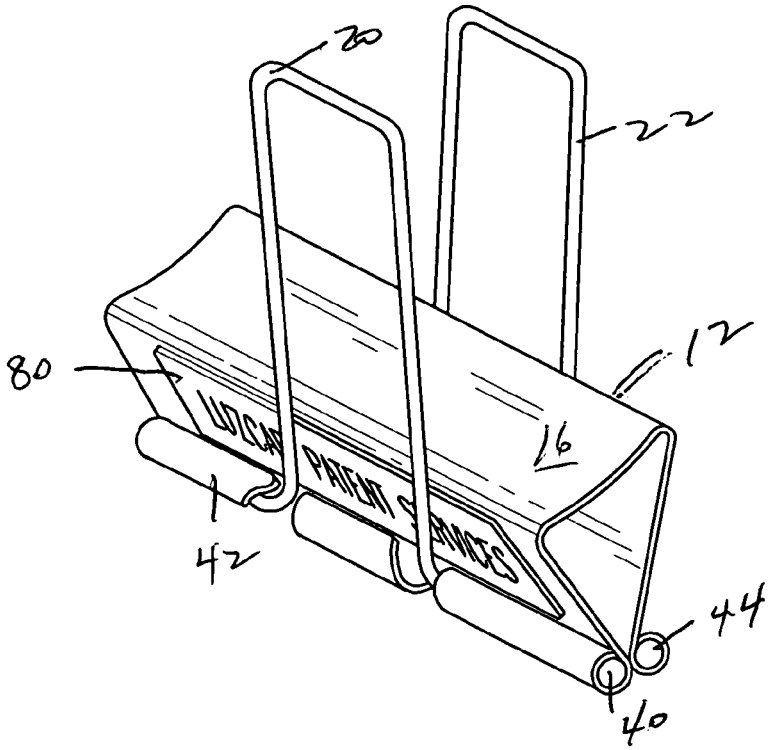

FIGS. 7 and 8 show a logo member 80 which can be attached to surfaces 14 or 16 of the gripping member 12, either by glue or magnetically.

Figure 9:
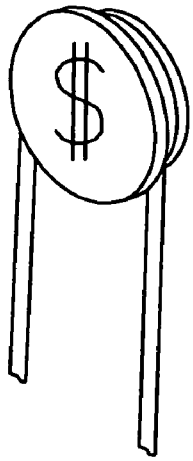
FIGS. 9, 10, and 11 are assembly views showing placement of a logo support member on one of the gripping legs of the money clip.
Figure 10:
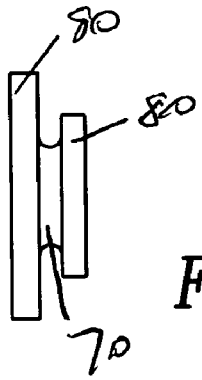
Figure 11:
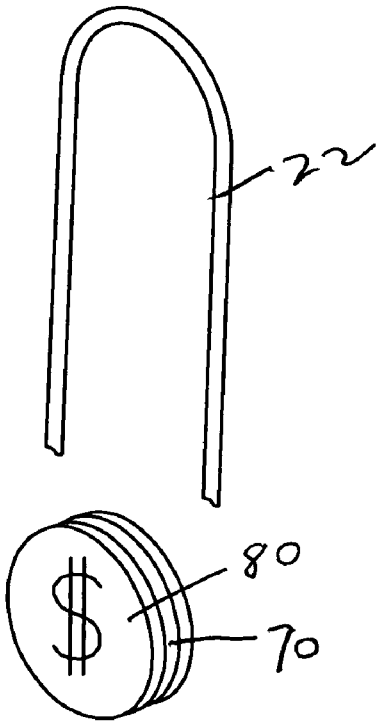
Figure 11A:
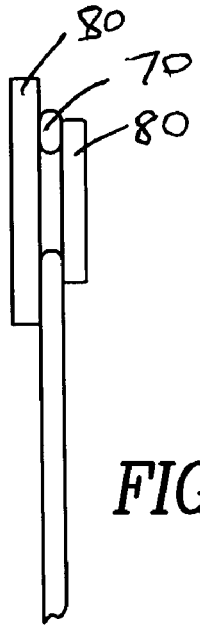

FIGS. 9 to 11 show leg 22 receiving therein a support member 70 having logos 80 on both sides of support member 70.

Figure 12:
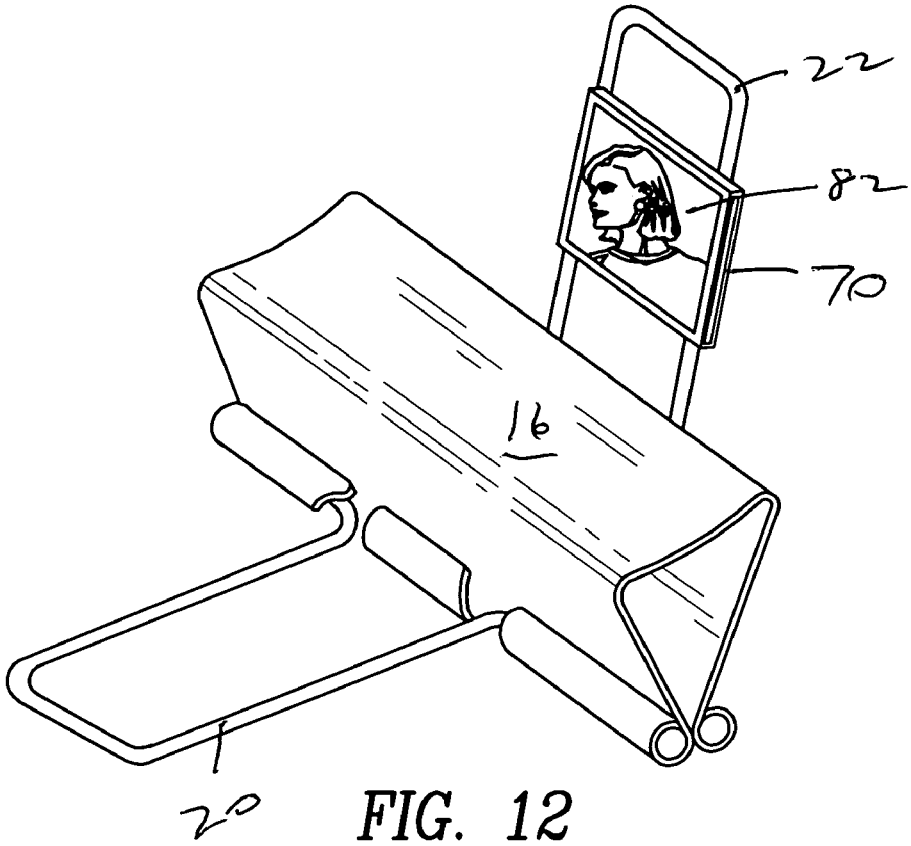
FIG. 12 is a perspective view of the money clip of the present invention having a picture support member thereon.
Figure 13:
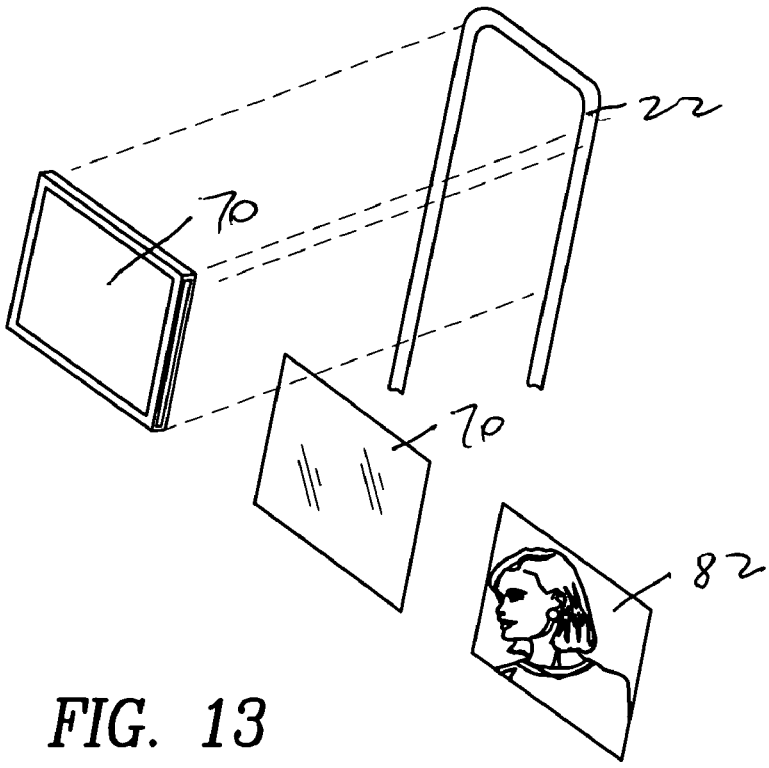
FIG. 13 is an assembly view of the money clip of the present invention having a picture support member thereon.

FIGS. 12 and 13 show gripping leg 22 having a support member 70 in the form of a picture frame for receiving a picture 82.

Figure 14:
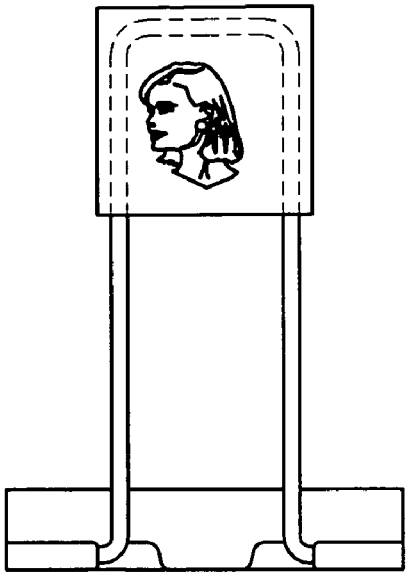
FIG. 14 shows a magnetic logo support member placed on one of the gripping legs of the money clip.

FIG. 14 shows a magnetic logo support member 70 placed on one of the gripping legs 20, 22, or 24 of the money clip 10.

Figure 15:
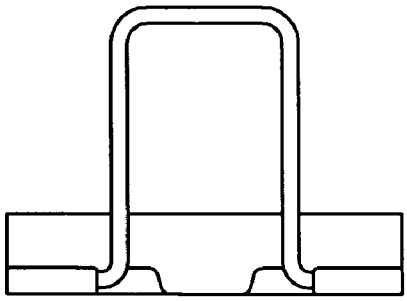
FIG. 15 shows a money clip having shorter gripping leg sections.

FIG. 15 shows a money clip having shorter gripping legs 20 and 22.

Figure 16:
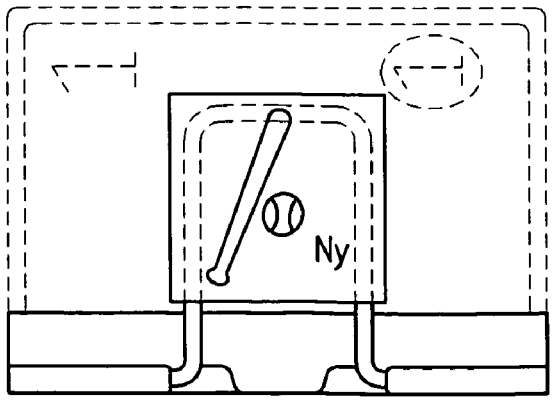
FIG. 16 shows a money clip having a different shaped gripping section and shorter gripping leg sections.

FIG. 16 shows a money clip having a different shaped gripping member 12 and shorter gripping legs 20 and 22.

OPERATION OF THE PRESENT INVENTION

In accordance with the present invention, logos or pictures may be placed on the gripping sections 14, 16, or 18 of the money clip 10 or on the gripping legs 20, 22, or 24 of the money clip 10. In addition, to make the money clip more versatile in design, one of the gripping legs 20 or 22 may be interchanged with a third or fourth gripping leg 24 having thereon different logos or pictures.

ADVANTAGES OF THE PRESENT INVENTION

The present invention has provided an improved money which has interchangeable gripping legs having alternate logos or pictures to provide a money clip which is more versatile in design.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. An improved money clip for holding and securing a stack of money, credit cards, and business documents, comprising:

a) a gripping member having a U shape including first, second, and third gripping sections (14, 16, and 18);

b) a first set of pivot sections formed on the lower edge of said first gripping section (14); and a second set of pivot sections formed on the lower edge of said third gripping section (18);

c) first and second gripping legs (20 and 22) each having pivots members at their upper ends which are pivotally and removably connected to said first and second sets of pivot sections formed on said first and third gripping sections (14 and 18);

d) a third gripping leg (24) having pivot members at its upper ends which are interchangeable with said first or second gripping legs (20 and 22);

e) logo support members formed on said first, second, or third gripping legs for receiving logos or pictures thereon having magnetic surfaces for receiving the logos or pictures thereon; and f) said first, second, or third gripping sections (14, 16, or 18) being coated with a surface for receiving engravings thereon.

* * * * *